US011514770B2

(12) United States Patent
Thompson Anandaraj

(10) Patent No.: US 11,514,770 B2
(45) Date of Patent: Nov. 29, 2022

(54) ALARM WITH ENHANCED RADIO PERFORMANCE BY ISOLATION OF RADIO FROM ALARM COMPONENTS

(71) Applicant: Carrier Corporation, Palm Beach Gardens, FL (US)

(72) Inventor: Talitha Preethi Thompson Anandaraj, Colorado Springs, CO (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 97 days.

(21) Appl. No.: 17/084,063

(22) Filed: Oct. 29, 2020

(65) Prior Publication Data

US 2021/0142647 A1 May 13, 2021

Related U.S. Application Data

(60) Provisional application No. 62/934,789, filed on Nov. 13, 2019.

(51) Int. Cl.
*G08B 21/18* (2006.01)
*H01Q 5/328* (2015.01)

(52) U.S. Cl.
CPC ..... *G08B 21/18* (2013.01); *H01Q 5/328* (2015.01)

(58) Field of Classification Search
CPC ..... G08B 21/18; G08B 29/18; G08B 25/10; H01Q 5/328; H01Q 1/52; H01Q 1/002; H01Q 1/48
USPC ..... 340/539.1; 30/539.1
See application file for complete search history.

(56) References Cited

U.S. PATENT DOCUMENTS

| | | | | |
|---|---|---|---|---|
| 3,657,714 | A | 4/1972 | Kessler | |
| 4,331,952 | A | 5/1982 | Galvin et al. | |
| 5,598,169 | A * | 1/1997 | Drabeck | G01S 13/75 343/702 |
| 5,933,077 | A | 8/1999 | Vogt et al. | |
| 7,492,270 | B2 | 2/2009 | Veerasamy | |
| 7,629,880 | B2 | 12/2009 | Stilp et al. | |
| 9,197,339 | B2 | 11/2015 | Jonkman | |
| 9,396,633 | B1 | 7/2016 | Sannala | |
| 9,581,342 | B2 | 2/2017 | Daniels et al. | |
| 9,609,462 | B2 | 3/2017 | Warren et al. | |
| 9,704,360 | B2 | 7/2017 | O'Brien et al. | |
| 9,722,292 | B2 | 8/2017 | Matsumoto et al. | |

(Continued)

FOREIGN PATENT DOCUMENTS

| | | |
|---|---|---|
| CN | 204238786 U | 4/2015 |
| CN | 204238787 U | 4/2015 |

(Continued)

OTHER PUBLICATIONS

European Search Report Aplication No. EP20207256; dated Mar. 12, 2021; pp. 9.

*Primary Examiner* — Omar Casillashernandez
(74) *Attorney, Agent, or Firm* — Cantor Colburn LLP

(57) ABSTRACT

An alarm or detector is provided and includes an alarm board assembly configured to perform one or more of alarm and detection operations and a communication module including an antenna configured to communicate with one or more other alarms and detectors. At least one of the alarm board and an alarm ground are isolated from a communication ground and the communication module and the communication module is isolated from a power source.

15 Claims, 5 Drawing Sheets

(56) References Cited

U.S. PATENT DOCUMENTS

| | | | | |
|---|---|---|---|---|
| 9,865,920 | B1 * | 1/2018 | Kuo | H01Q 5/321 |
| 10,319,213 | B1 | 6/2019 | Conner et al. | |
| 10,375,356 | B2 | 8/2019 | Sannala | |
| 10,644,539 | B2 * | 5/2020 | Pivonka | H02J 50/80 |
| 2005/0134471 | A1 * | 6/2005 | Kovach | G08B 13/08 340/539.1 |
| 2008/0100463 | A1 | 5/2008 | Shirlee | |
| 2015/0083810 | A1 | 3/2015 | Ching | |
| 2020/0076488 | A1 * | 3/2020 | Brunel | H04B 7/0617 |
| 2020/0252041 | A1 * | 8/2020 | Ishizuka | H03H 7/1775 |
| 2021/0003623 | A1 * | 1/2021 | Stock | H01Q 9/44 |
| 2021/0268850 | A1 * | 9/2021 | Kessler | B60C 23/0454 |

FOREIGN PATENT DOCUMENTS

| | | | |
|---|---|---|---|
| CN | 204926359 | U | 12/2015 |
| CN | 106781175 | A | 5/2017 |
| WO | 20170196752 | A1 | 11/2017 |

* cited by examiner

ALARM WITH ENHANCED RADIO PERFORMANCE BY ISOLATION OF RADIO FROM ALARM COMPONENTS

CROSS-REFERENCE TO RELATED APPLICATIONS

This application claims the benefit of U.S. Provisional Application No. 62/934,789 filed Nov. 13, 2019, which is incorporated herein by reference in their entirety.

BACKGROUND

The following description relates to alarms and, more specifically, to an alarm with enhanced radio performance by isolation of a radio from alarm components.

Alarms and detectors (hereinafter referred to as "alarms" for clarity and brevity) usually have various electrical components like sensors, batteries, power supply circuitry, sounders, speakers, etc. In some cases, alarms also have communication devices, such as radio communicators or modules with antennae that operate in sub-GHz frequencies. These communications devices allow groups of alarms to communicate with one another in a wireless manner. For such a grouping of alarms to conduct such wireless communications, each alarm has to be within range of at least one other alarm. It has been found, however, that the various electrical components can impede the performance of the communications devices and thus reduce the effective range of some alarms.

In particular cases in which an alarm is equipped with a radio module with an antenna, the radio antenna helps in achieving an effective range of wireless communication for the alarm. Nevertheless, the range is still affected at certain orientations of the alarm (this is depicted on polar plots referenced below). These dips in range can result in the alarm being unable to meet communications range requirements that are set by local standards.

BRIEF DESCRIPTION

According to an aspect of the disclosure, an alarm or detector is provided and includes an alarm board assembly configured to perform one or more of alarm and detection operations and a communication module including an antenna configured to communicate with one or more other alarms and detectors. At least one of the alarm board and an alarm ground are isolated from a communication ground and the communication module and the communication module is isolated from a power source.

In accordance with additional or alternative embodiments, the communication module and the antenna operate in a sub-GHz radio frequency.

In accordance with additional or alternative embodiments, only the alarm board and the alarm ground are isolated from the communication ground and the communication module.

In accordance with additional or alternative embodiments, the alarm board and the alarm ground are isolated from the communication ground and the communication module and the communication module is isolated from the power source.

In accordance with additional or alternative embodiments, isolation of the alarm board and the alarm ground from the communication ground and the communication module is provided by a first filter, isolation between the communication module and the power source is provided by a second filter and at least one of the first and second filters has one or more of a reflection coefficient parameter close to about −100 dB and an insertion loss parameter of about 0 db across a bandwidth of an operating frequency of the communication module and the antenna and a cut-off frequency of the filter nearly equal to or slightly less than the operating frequency of the communication module and the antenna.

According to another aspect of the disclosure, an alarm or detector is provided and includes a first board on which electrical components are disposed, a communication module including an antenna, a power source, a first ground, a communication ground and first and second buses, each of which is electrically communicative with the first board and the communication module. The first bus is tied to the first ground and the communication ground and the second bus is tied to the power source. The alarm or detector further includes at least one of a first isolation element disposed on the first bus to isolate the first board and the first ground from the communication ground and the communication module and a second isolation element disposed on the second bus to isolate the power source from the communication module.

In accordance with additional or alternative embodiments, the electrical components are configured to execute one or more of alarm and detection operations and the communication module is configured to communicate with one or more other alarms and detectors and the antenna is configured to increase a range of the communication module.

In accordance with additional or alternative embodiments, the communication module and the antenna operate in a sub-GHz radio frequency.

In accordance with additional or alternative embodiments, the alarm or detector includes the first isolation element.

In accordance with additional or alternative embodiments, the alarm or detector includes the first and second isolation elements.

In accordance with additional or alternative embodiments, the first and second isolation elements each include a filter.

In accordance with additional or alternative embodiments, the filter has a reflection coefficient parameter close to about −100 dB and an insertion loss parameter of about 0 db across a bandwidth of an operating frequency of the communication module and the antenna.

In accordance with additional or alternative embodiments, a cut-off frequency of the filter is nearly equal to or slightly less than an operating frequency of the communication module and the antenna.

In accordance with additional or alternative embodiments, the filter includes a series of one or more of ferrite beads and low pass filters.

According to another aspect of the disclosure, an alarm or detector is provided and includes an alarm board assembly configured to perform one or more of alarm and detection operations, a communication module including an antenna configured to communicate with one or more other alarms and detectors, a power source, an alarm ground, a communication ground and first and second buses, each of which is electrically communicative with the alarm board assembly and the communication module. The first bus is tied to the alarm ground and the communication ground and the second bus is tied to the power source. The alarm or detector further includes one of a first isolation element disposed on the first bus to isolate the alarm board assembly and the alarm ground from the communication ground and the communication module or the first isolation element and a second isolation element disposed on the second bus to isolate the power source from the communication module.

In accordance with additional or alternative embodiments, the communication module and the antenna operate in a sub-GHz radio frequency.

In accordance with additional or alternative embodiments, the first and second isolation elements each include a filter.

In accordance with additional or alternative embodiments, the filter has a reflection coefficient parameter close to about −100 dB and an insertion loss parameter of about 0 db across a bandwidth of an operating frequency of the communication module and the antenna.

In accordance with additional or alternative embodiments, a cut-off frequency of the filter is nearly equal to or slightly less than an operating frequency of the communication module and the antenna.

In accordance with additional or alternative embodiments, the filter includes a series of one or more of ferrite beads and low pass filters These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features and advantages of the disclosure are apparent from the following detailed description taken in conjunction with the accompanying drawings in which:

and

Figure 7:
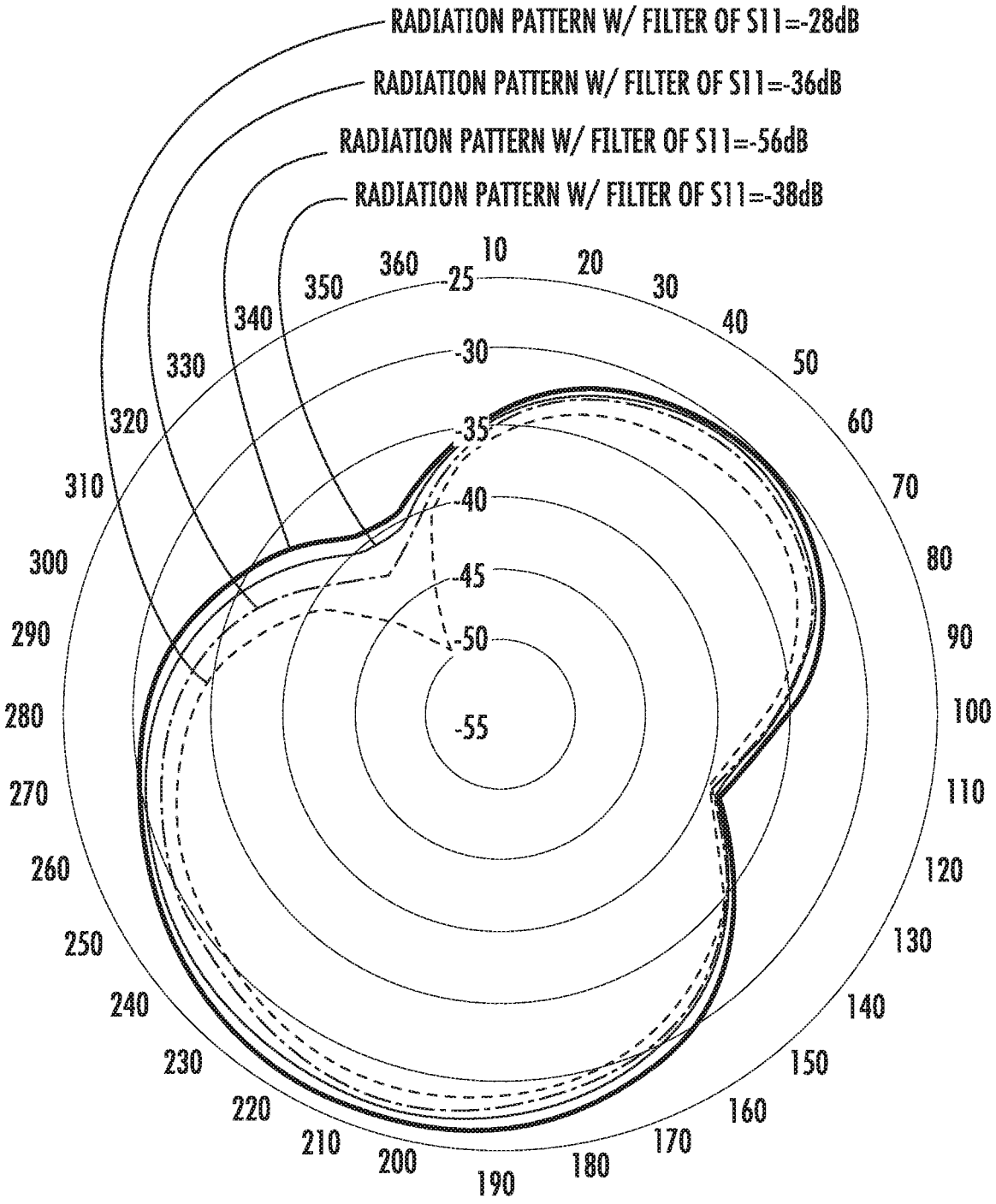

FIG. 7 is a graphical depiction of radiation patterns of an alarm with low pass filters of different reflection coefficients.

These and other advantages and features will become more apparent from the following description taken in conjunction with the drawings.

DETAILED DESCRIPTION

As will be described below, an alarm is provided. The alarm includes a radio module where the alarm board and the radio module share power lines, ground lines (or planes) and communication lines (or communication signal lines). The ground on the alarm board, which is common to a smoke sensor, a carbon monoxide sensor, batteries and other similar electrical components, is separated from a radio ground using filter circuits and ferrite beads. In order to isolate the alarm ground and the radio ground only at the required frequency of operation while maintaining direct current (DC) continuity, low pass filter circuit in series with a ferrite bead are tuned to operate at appropriate frequencies with an insertion loss/gain of the filter circuits, an S21/S12 parameter, equal to 0 dB and a reflection coefficient of the filter circuits, an S11/S22 parameter, in a range of about −40 dB to −60 dB or about −40 dB to −100 dB between the radio ground and the ground of the smoke and carbon monoxide sensors, the batteries and the other similar electrical components (i.e., the "alarm ground"). The ferrite bead is chosen to have a high reactance in the range of 150 ohms to 200 ohms at the operating frequency of the radio module. A similar filter can be implemented between the power lines from the alarm board to the radio board to improve the radio performance.

Figure 1:
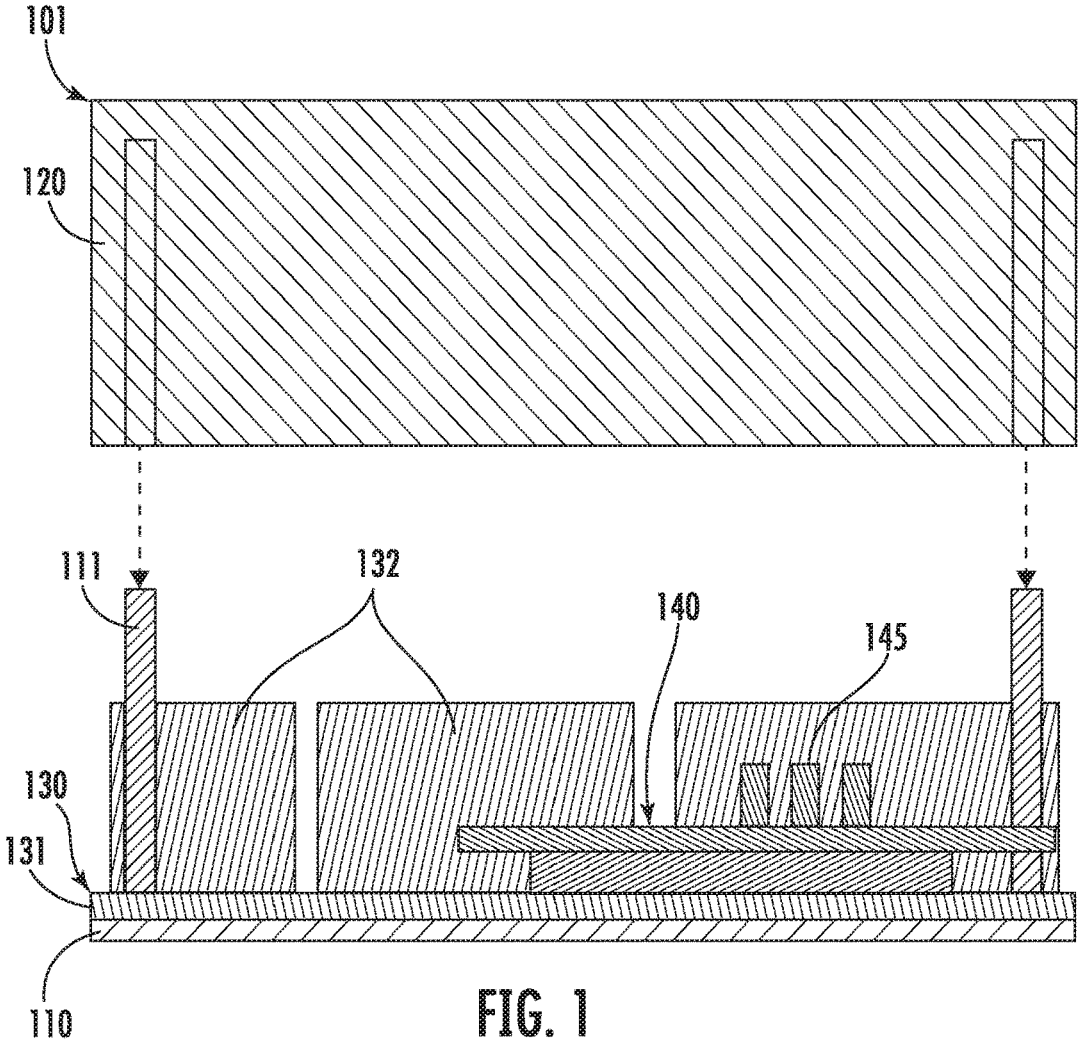
FIG. 1 is an exploded, side schematic view of an alarm in accordance with embodiments.
Figure 2:
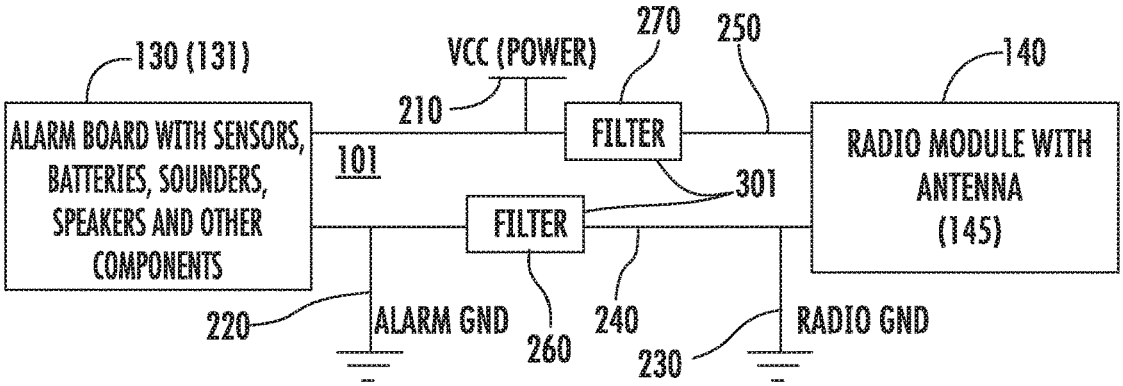
FIG. 2 is a schematic diagram of an isolation of a radio module in an alarm from electrical components of the alarm in accordance with embodiments.

With reference to FIGS. 1 and 2, an alarm or detector 101 is provided and includes a structural backplane 110, a cover 120 that is connectable to the structural backplane 110 by guide bosses 111, an alarm board assembly 130 that is supported on the structural backplane 110 and a communication module 140 that is indirectly supported on the structural backplane 110 and includes an antenna 145. The alarm board assembly 130 configured to perform one or more of alarm and detection operations and includes an alarm or first board (hereinafter referred to as a "first board") 131 and electrical components 132 that are operably disposed on the first board 131 to execute the one or more of the alarm and detection operations. In accordance with embodiments, the electrical components 132 can include smoke, carbon monoxide or other sensors, power supply circuitry, sounders, speakers, etc., as may be present in a detection and alarm device. The communication module 140 is configured to wirelessly communicate with one or more other alarms, detectors and related devices via the antenna 145. In accordance with embodiments, the antenna 145 can include or be provided as a monopole antenna and the communication module 140 and the antenna 145 operate in a sub-GHz radio frequency (RF).

As shown in FIG. 2, the alarm or detector 101 also includes a power source 210, an alarm or first ground (hereinafter referred to as a "first ground") 220, a communication ground 230, a first bus 240 and a second bus 250. The first bus 240 is electrically communicative with the alarm board assembly 130 (i.e., with the first board 131) and with the communication module 140. The second bus 250 is electrically communicative with the alarm board assembly 130 (i.e., with the first board 131) and with the communication module 140. The first bus 240 is tied to the first ground 220 and the communication ground 230. The second bus 250 is tied to the power source 210.

As shown in FIG. 2, the alarm or detector 101 further includes isolation to improve a performance of the communication module 140 and the antenna 145. The isolation can be provided by a first isolation element 260 that is disposed on the first bus 240 to isolate the alarm board assembly 130 and the first ground 220 from the communication ground 230 and the communication module 140. The isolation can alternatively be provided by a combination of the first isolation element 260 and a second isolation element 270 that is disposed on the second bus 250 to isolate the power source 210 from the communication module 140.

Explained differently, the alarm or detector 101 is configured such that at least one of the alarm board assembly 130 or the first board 131 and the first ground 220 are isolated from the communication ground 230 and the communication module 140 and the communication module 140 is isolated from the power source 210.

Figure 3:
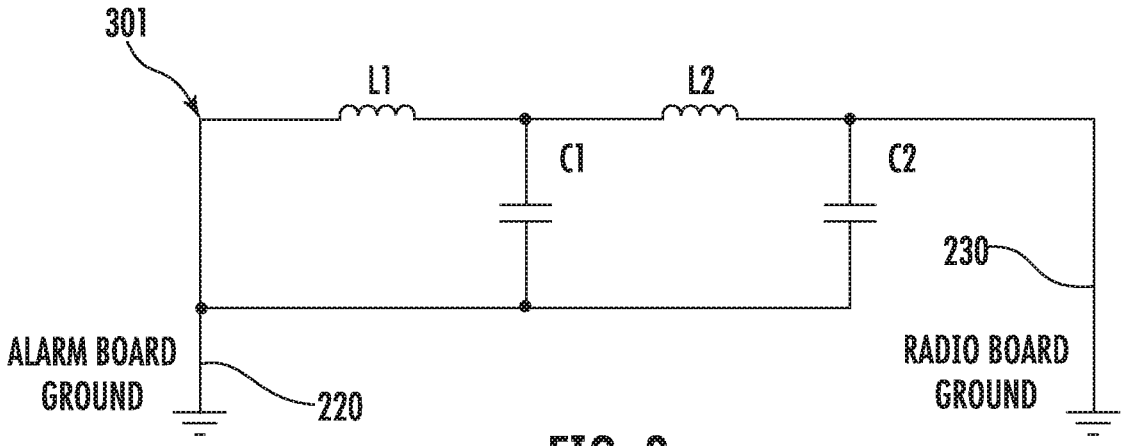
FIG. 3 is a schematic circuit diagram of a filter for use in the isolation of FIG. 2 in accordance with embodiments.
Figure 4:
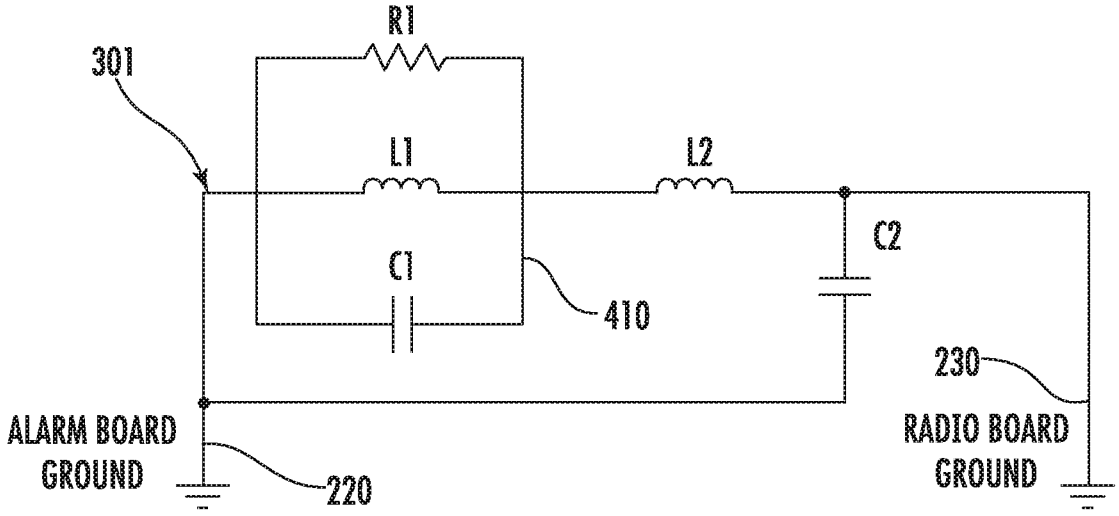
FIG. 4 is a schematic circuit diagram of a filter for use in the isolation of FIG. 2 in accordance with embodiments.

With continued reference to FIG. 2 and with additional reference to FIGS. 3 and 4, the first and second isolation elements 260 and 270 (see FIG. 2) can each include a filter 301. In accordance with additional or alternative embodiments, the filter 301 has a reflection coefficient parameter of the filter, S11/S22 should be in the range of −40 dB to −60 dB or −40 dB to −100 dB and an insertion loss parameter, S12/S21 of about 0 db across a bandwidth of an operating frequency of the communication module 140 and the antenna 145. In accordance with additional or alternative embodiments, for a low pass filter, a cut-off frequency of the filter 301 is or should be slightly less than an operating frequency of the communication module 140 and the antenna 145 and, in a case of a low-pass filter, is or should be nearly equal to or slightly higher than the operating frequency of the communication module 140. By doing so, the filter is designed to pass all lower frequency signals between the first ground 220 and the communication ground 230 and any signal at the operating frequency is eliminated. When the monopole antenna radiates, the communication ground 230 also radiates to imitate a perfect dipole antenna. Since the radiation of a ground plane plays a major role in the performance of the monopole antenna, an isolated communication ground 230 is provided to aid in the performance of the antenna. Since the first ground 220 is shared by sensors, sounders and other components, they impact the radiation of the antenna negatively. The filter element 260 helps to isolate the first ground 220 so the communication ground 230 can act as a perfect monopole antenna ground and help in providing for better or improved radiation performance.

As shown in FIGS. 3 and 4, the filter 301 is disposed between the first ground 220 and the communication ground 230 and is thus positioned as the first isolation element 260. The following description will refer to this case. This is done for purposes of clarity and brevity and it is to be understood that the second isolation element 270 may have a similar configuration.

The filter 301 can include a series of one or more of ferrite beads and low pass filters. For example, as shown in FIG. 3, the filter 301 can include first and second impedance elements L1 and L2 disposed in series between the first ground 220 and the communication ground 230 as well as a first capacitor C1 in parallel with the first impedance element L1 and a second capacitor C2 in parallel with the second impedance element L2. As another example, as shown in FIG. 4, the filter 301 can include first and second impedance elements L1 and L2 disposed in series between the first ground 220 and the communication ground 230 as well as a first capacitor C1 and a resistor R1 in parallel with the first impedance element L1 to form a first circuit element 410 and a second capacitor C2 in parallel with the first circuit element 410.

The ferrite bead is chosen to have high impedance in the range of 500 ohms to 1 kohms with high reactance in the range of 150 ohms to 200 ohms as this provides the high impedance isolation between the communication ground 230 and the first ground 220. The filter is designed to be either a low pass filter with the cut-off frequency slightly lower than the cut-off frequency and for a high pass filter with the cut-off frequency slightly higher than the cut-off frequency. A low pass filter passes all signals lower than the cut-off frequency and blocks higher frequency signals. A high pass filter passes all signals higher than the cut-off frequency and blocks lower frequency signals. So it is essential to design the filter accordingly with the operating frequency of the radio in mind.

Figure 5:
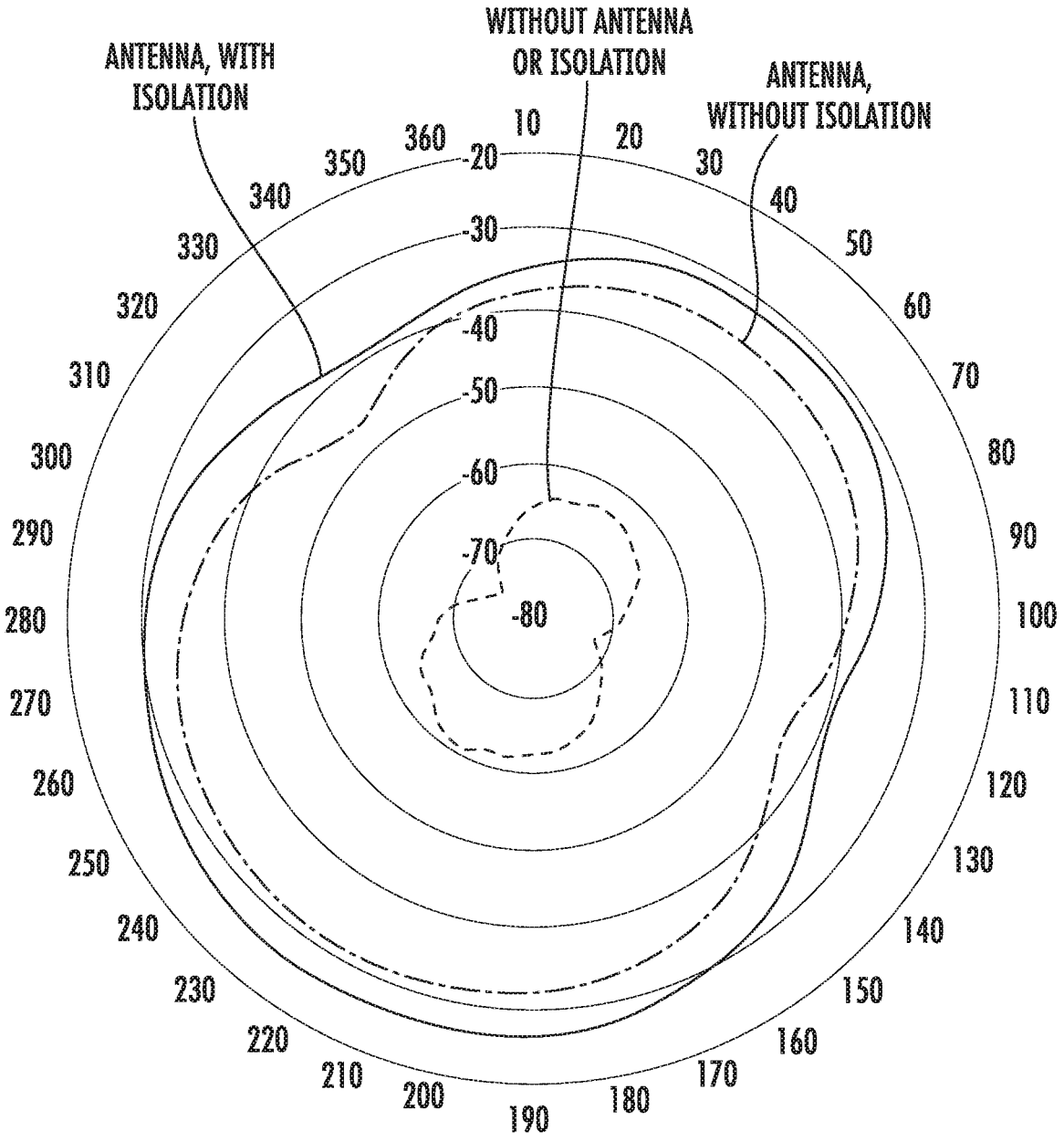
FIG. 5 is a graphical depiction of communication performance of an alarm without an antenna, with an antenna but without isolation and with an antenna and isolation in accordance with embodiments.

With reference to FIG. 5, enhancement of communication performance of the alarm or detector 101 is illustrated in comparison to an alarm or detector without an antenna or isolation and in comparison to an alarm or detector with an antenna but without isolation. As shown in FIG. 5, where the alarm or detector 101 is provided with isolation (i.e., isolation provided by the first isolation element 260 and the second isolation element 270), the alarm or detector 101 exhibits substantially improved communication performance as compared to the non-antenna and non-isolation case in terms of substantially increased range and improved power output on the radiation pattern and exhibits more improved communication performance as compared to the antenna without isolation case in terms of further increased range and substantial decreases in polar lobe effects.

Figure 6:
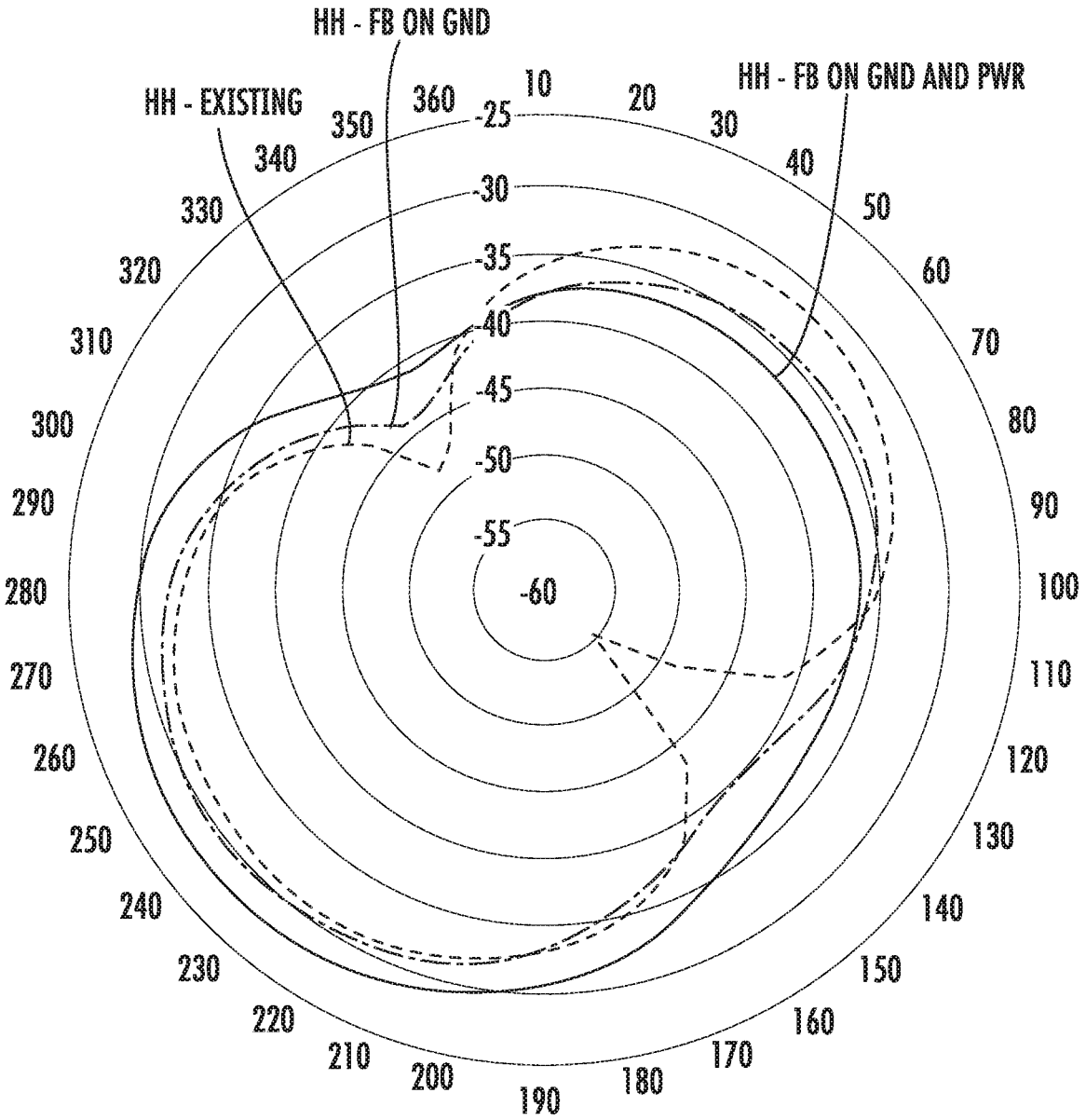
FIG. 6 is a graphical depiction of radiation patterns of an alarm with an antenna but without isolation, with an antenna and ground line filtering only and with an antenna and filtering on ground and power lines in accordance with embodiments.

With reference to FIG. 6, enhancement of radiation patterns of the alarm or detector 101 is illustrated in comparison to an alarm or detector without any isolation. As shown in FIG. 6, where the alarm or detector 101 is provided with only the first isolation element 260 (HH—FB on GND), the alarm or detector 101 exhibits improved radiation patterns as compared to the non-isolation case (HH—existing) in terms of decreased polar lobe effects and, where the alarm or detector 101 is provided with the first and second isolation elements 260 and 270 (HH—FB on GND and PWR), the alarm or detector 101 exhibits more improved radiation patterns as compared to the single-isolation case (HH—FB on GND) in terms of at least further decreases in polar lobe effects.

As shown in FIG. 6, the radiation pattern with and without isolation is shown. A radiation pattern is a polar plot of power output from the radio received at a given distance. The radiation pattern shown is measured at every 10 degree increments, higher the power output better communication range, lower the power output lower communication range. Ideally, for a Line of Sight communication where an alarm with a radio is communicating with another alarm with a radio without any obstruction in between them, thereby line of sight communication, the rule of thumb is that 6 dB increase in radiated power out will yield twice the communication distance.

With reference to FIG. 7, the radiation pattern of a radio operating at 926 MHz with low pass filters of different reflection coefficients, S11 parameters is shown. FIG. 7 illustrates that the power out of the antenna is improved as the reflection coefficient decreases and becomes more negative in number.

Technical effects and benefits of the present disclosure are the provision of an alarm that uses a monopole antenna with improved or enhanced performance owing to isolation between the alarm ground and the radio ground so that the alarm meets specified range requirements (i.e., 100 meter open air range requirements).

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. An alarm or detector, comprising:

an alarm board assembly configured to perform one or more of alarm and detection operations; and a communication module including an antenna configured to communicate with one or more other alarms and detectors, wherein:

the alarm board and an alarm ground are isolated from a communication ground and the communication module; and the communication module is isolated from a power source;

wherein an isolation of the alarm board and the alarm ground are isolated from the communication ground and the communication module and an isolation of the communication module is isolated from the power source are configured such that the alarm or detector has a radiation pattern with flattened polar lobe effects.

2. The alarm or detector according to claim 1, wherein the communication module and the antenna operate in a sub-GHz radio frequency.

3. The alarm or detector according to claim 1, wherein only the alarm board and the alarm ground are isolated from the communication ground and the communication module.

4. The alarm or detector according to claim 1, wherein:

isolation of the alarm board and the alarm ground from the communication ground and the communication module is provided by a first filter, isolation between the communication module and the power source is provided by a second filter, and at least one of the first and second filters has one or more of:

a reflection coefficient parameter of about −100 dB and an insertion loss parameter of about 0 db across a bandwidth of an operating frequency of the communication module and the antenna, and a cut-off frequency of the filter equal to or less than the operating frequency of the communication module and the antenna.

5. An alarm or detector, comprising:

a first board on which electrical components are disposed;

a communication module including an antenna; a power source; an alarm ground;

a communication ground; first and second buses, each of which is electrically communicative with the first board and the communication module, the first bus being tied to the alarm ground and the communication ground and the second bus being tied to the power source;

a first isolation element disposed on the first bus to isolate the first board and the alarm ground from the communication ground and the communication module;

a second isolation element disposed on the second bus to isolate the power source from the communication module;

wherein the first and second isolation elements each comprise a filter; and wherein the filter has a reflection coefficient parameter about of about −100 dB and an insertion loss parameter of about 0 db across a bandwidth of an operating frequency of the communication module and the antenna.

6. The alarm or detector according to claim 5, wherein:

the electrical components are configured to execute one or more of alarm and detection operations, and the communication module is configured to communicate with one or more other alarms and detectors and the antenna is configured to increase a range of the communication module.

7. The alarm or detector according to claim 5, wherein the communication module and the antenna operate in a sub-GHz radio frequency.

8. The alarm or detector according to claim 5, wherein the alarm or detector comprises the first isolation element.

9. The alarm or detector according to claim 5, wherein the first and second isolation elements are configured such that the alarm or detector has a radiation pattern with flattened polar lobe effects.

10. The alarm or detector according to claim 5, wherein a cut-off frequency of the filter is equal to or less than an operating frequency of the communication module and the antenna.

11. The alarm or detector according to claim 5, wherein the filter comprises a series of ferrite beads and low pass filters.

12. An alarm or detector, comprising:

an alarm board assembly configured to perform one or more of alarm and detection operations;

a communication module including an antenna configured to communicate with one or more other alarms and detectors;

a power source;

an alarm ground;

a communication ground;

first and second buses, each of which is electrically communicative with the alarm board assembly and the communication module, the first bus being tied to the alarm ground and the communication ground and the second bus being tied to the power source;

a first isolation element disposed on the first bus to isolate the alarm board assembly and the alarm ground from the communication ground and the communication module;

the first isolation element and a second isolation element disposed on the second bus to isolate the power source from the communication module;

wherein the first and second isolation elements each comprise a filter; and wherein the filter has a reflection coefficient parameter about of about −100 dB and an insertion loss parameter of about 0 db across a bandwidth of an operating frequency of the communication module and the antenna.

13. The alarm or detector according to claim 12, wherein the communication module and the antenna operate in a sub-GHz radio frequency.

14. The alarm or detector according to claim 12, wherein a cut-off frequency of the filter is equal to or less than an operating frequency of the communication module and the antenna.

15. The alarm or detector according to claim 12, wherein the filter comprises a series of ferrite beads and low pass filters.

* * * * *